United States Patent [19]

Budinger et al.

[11] Patent Number: 4,866,339

[45] Date of Patent: Sep. 12, 1989

[54] BEAM MODE FLUORESCENT LAMP

[75] Inventors: A. Bowman Budinger, Westford; Wojciech W. Byszewski, Concord; Joseph M. Proud, Wellesley Hills, all of Mass.

[73] Assignee: GTE Laboratories Incorporated, Waltham, Mass.

[21] Appl. No.: 267,661

[22] Filed: Nov. 3, 1988

Related U.S. Application Data

[63] Continuation of Ser. No. 136,067, Dec. 21, 1987, abandoned.

[51] Int. Cl.[4] ..... H01J 61/10; H01J 61/42

[52] U.S. Cl. ..... 313/492; 313/616

[58] Field of Search ..... 313/616, 492

[56] References Cited

U.S. PATENT DOCUMENTS

| | | | |
|---|---|---|---|
| 2,812,465 | 11/1957 | Germeshausen | 313/616 |
| 4,408,141 | 10/1983 | Byszewski et al. | 313/350 X |
| 4,521,718 | 6/1985 | Byszewski et al. | 315/99 |

*Primary Examiner*—Palmer C. DeMeo

*Attorney, Agent, or Firm*—James J. Cannon, Jr.

[57] ABSTRACT

A beam mode discharge lamp typically has a shortcoming in that emitted light is reduced due to the deposition of cathode material on the phosphor surface. Such deposition can be reduced through the addition of a conductive mesh about the filaments to entrap cathode material and inhibit same from attacking the phosphor material.

1 Claim, 4 Drawing Sheets

BEAM MODE FLUORESCENT LAMP

This is a continuation of co-pending application Ser. No. 136,037, filed on Dec. 21, 1987, now abandoned.

BACKGROUND OF THE INVENTION

1. Field of the Invention

This invention relates to an improvement in the maintenance characteristic (decrease in light output with operating time) of a gas discharge lamp.

2. General Background

Such a gas discharge lamp has been in the shape of a 100 watt incandescent lamp and is referred to as a beam mode discharge (BMD) lamp. A shortcoming of this lamp is the reduction of emitted light during operation due to the deposition of cathode material on the phosphor surface.

The general operating principles of the BMD lamp and related prior art have been described previously. The particular BMD lamp embodiment modified by this disclosure is described in U.S. Pat. No. 4,408,141, "Dual Cathode Beam Mode Fluorescent Lamp". Additional BMD patents which have been issued are: U.S. Pat. No. 4,413,204, "Non-Uniform Resistance Beam Mode Fluorescent Lamp"; U.S. Pat. No. 4,450,380, "Multielectrode Array For A Beam Mode Lamp"; U.S. Pat. No. 4,494,046, "Single Cathode Beam Mode Fluorescent Lamp for DC Use"; U.S. Pat. No. 4,521,718, "Beam Mode Lamp with Voltage Modifying Electrode"; U.S. Pat. No. 4,516,057, "Multielectrode Array For A Beam Mode Fluorescent Lamp"; and U.S. Pat. No. 4,518,897, "Twin Anode Beam Mode Fluorescent Lamp".

OBJECTS OF THE INVENTION

The principal of this invention is to provide a new and improved beam mode fluorescent lamp in which an additional mesh-type electrode within the lamp volume, when properly self-biased, intercepts material evaporated from the cathode before it can land on the phosphor layer and contribute to lowering the light output.

SUMMARY OF THE INVENTION

In accordance with one aspect of the invention, an improvement is provided for a beam mode fluorescent lamp. Such a lamp has an enclosing light transmissive envelope having an interior surface. A lamp base having a socket therewithin is coupled to the envelope to form a complete enclosure with the envelope. A phosphor coating that is deposited on the interior surface converts ultraviolet radiation into visible radiation. A fill of noble gas and mercury vapor resides within the envelope. A pair of filaments, each covered with an alkaline earth coating, have respective opposed ends. The alkaline earth coatings have a tendency to decompose into elemental form upon application of heat thereto. Respective sets of filament connecting leads couple the filaments to the socket. The improvement comprises electrically conductive grid means for inhibiting deposits of the decomposed coatings upon the phosphor coating.

In accordance with certain features of the invention, the grid means is a singular structure for surrounding both of the filaments. The grid means can be structured to electrically float. In other features, the grid means can include a first grid for the first filament, and a second grid for the second filament. Both grids can be isolated from each other. The grid means can electrically float.

BRIEF DESCRIPTION OF THE DRAWING

Other objects, advantages, and features of this invention, together with its construction and mode of operation, will become apparent from the following description, when read in conjunction with the accompanying drawing, in which like reference numerals refer to like components, and in which.

DESCRIPTION OF BEAM MODE LAMP

Figure 1:
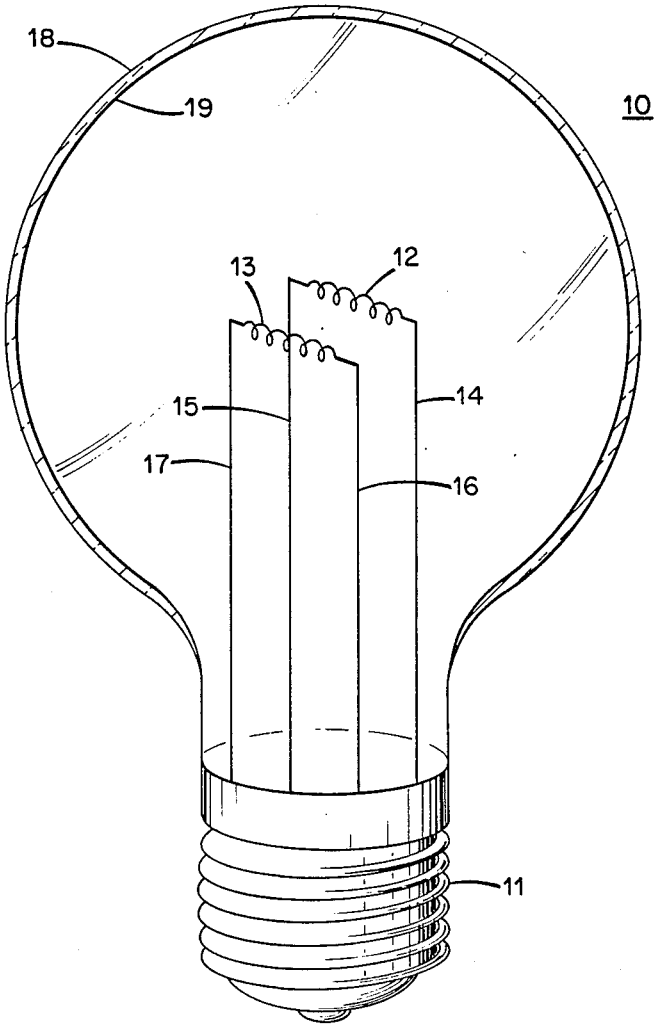
PRIOR ART Fig. 1.
FIG. 1 is a schematic view of a beam mode fluorescent lamp of the prior art.

The beam mode lamp 10, as pictured in FIG. 1, has a base 11 with a socket therein for electrical connection thereto. The lamp 10 runs on AC voltage and operates at about 20 volts. The filaments 12, 13, covered with an alkaline earth oxide coating, act as thermionic emitting sources when power is delivered to the discharge through the filament connecting leads 14, 15, 16, 17. The BMD lamp 10 is usually operated in an AC fashion where each filament 12, 13 acts alternatively as cathode and anode every half cycle. Lamp 10 starting is accomplished through either a preheat or rapid start method (see Waymouth, "Electric Discharge Lamps" pp. 59 to 62). During lamp 10 starting, current is delivered to the filaments 12, 13 to bring them up to thermionic emitting temperature. This can be accomplished by placing the two filaments 12, 13 in series with the power supply output for a short period of time (preheat mode) after the lamp 10 has been turned on or by supplying current to the filaments 12, 13 continuously while the lamp 10 is on (rapid start).

The lamp envelope 18 is filled with a noble gas (to a few torr pressure) and mercury vapor. The discharge formed between the two filaments diffuses into the envelope 18 space beyond the filaments 12, 13, efficiently generating ultraviolet radiation. This radiation in turn is absorbed by the phosphor layer 19 coated on the inside of the lamp envelope 18. The phosphor 19 converts ultraviolet radiation into visible emission. The light output from this lamp 10 consists mainly of visible phosphor 19 emission although a small portion comes directly from discharge radiation.

The phenomena of "end blackening" in the fluorescent lamp has its equivalent in the BMD lamp 10. This is manifest as a slow darkening of the total phosphor surface 19, with operating time, and is caused by evaporation, diffusion and subsequent condensation of filament material on the phosphor. This phenomena is accelerated in the BMD lamp 10 due to geometric considerations (i.e., closeness of the total phosphor surface layer to the filaments) as well as enhanced power loading of the filaments 12, 13 themselves. Scanning electron microscope observations of the film deposited on the phosphor surface 19 of BMD lamps 10 operated for several hundred hours have shown a high concentration of barium, the most volatile component of the filament coating along with traces of strontium, a less volatile component. A large portion of the barium vapor emanating from the filaments 12, 13 is ionized either upon evaporation or during diffusion through the plasma. BMD lamp 10 emission spectra contain several weak Ba+ lines. Previous attempts at reducing the rate of Ba+ evaporation have concentrated on reducing the temperature of the "hot spot" formed on the filament, i.e.: the area where evaporation is the highest. Although this results in reduced Ba+ evaporation, lower electrode emissivity also results.

DESCRIPTION OF PREFERRED EMBODIMENTS

Figure 2:
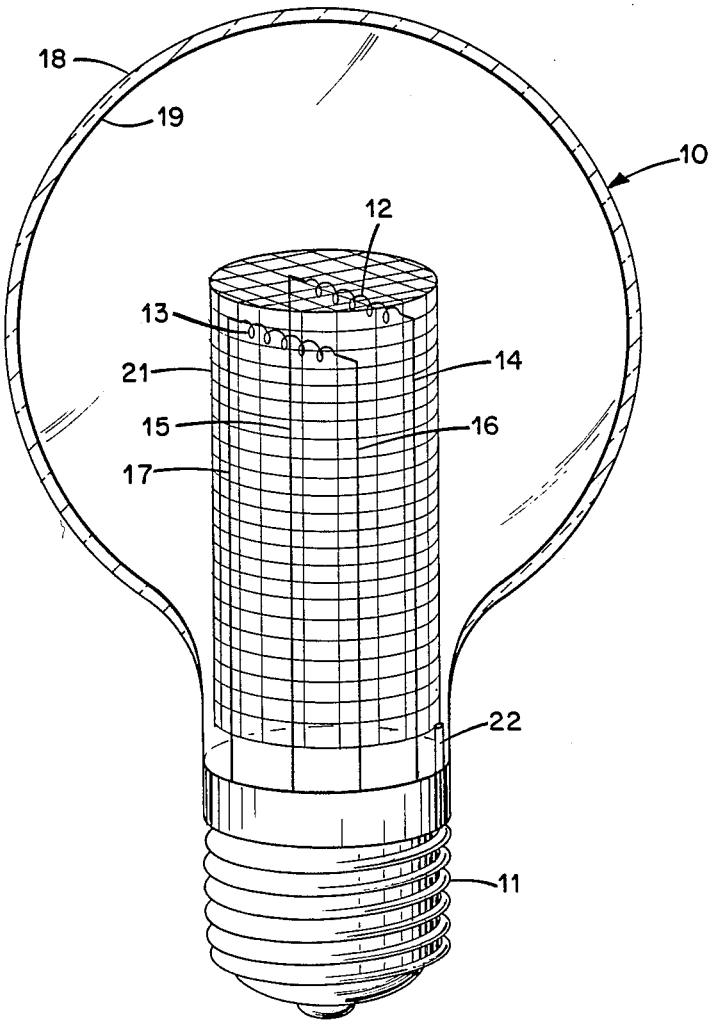
FIG. 2 is a schematic view of a beam mode fluorescent lamp in accordance with the invention.

The instant invention relates to the position and function of at least one additional electrode inside the lamp envelope which factors significantly reduce Ba+ diffusion to the phosphor surface. The use of at least one additional electrode as a modifying electrode to raise the operating voltage of a beam mode lamp is disclosed in U.S. Pat. No. 4,521,718. FIG. 2 shows one embodiment of this concept. This figure shows a conventional BMD lamp with an additional mesh electrode 21 installed. Mesh 21, as shown in FIG. 2, is generally cylindrical in shape and is enclosed at its upper end by a mesh top and at its lower end by the lamp base 11. While the precise shape of mesh 21 may be varied, it must surround filaments 12, 13, and be positioned such that it is interposed between filaments 12, 13 and phosphor surface 19. The mesh 21 is supported on the lamp header (i.e. the base 11) by the mesh support wire 22 in such a manner as to allow the mesh 21 to be electrically floating. In U.S. Pat. No. 4,521,718, the modifying electrode is also a mesh, but it is not free floating. This mesh 21 then appears to acquire a negative potential with respect selectively acquires positively ionized barium.

Figure 3:
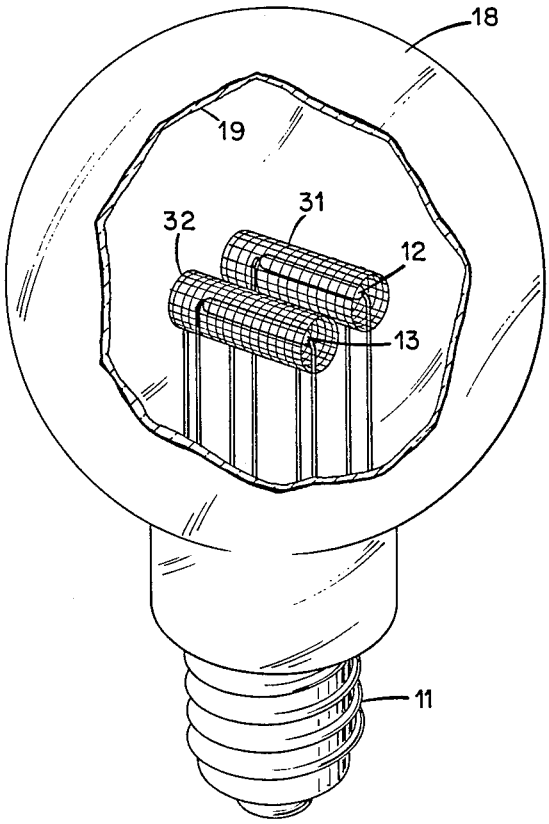
FIG. 3 is a perspective view (partly broken away) of another embodiment of a beam mode fluorescent lamp which can utilize another the invention.

An alternative mesh electrode configuration is shown in FIG. 3, which configuration is identical to that shown in FIG. 3 of U.S. Pat. No. 4,521,718, except that in this application it is free floating, whereas in said patent the mesh is electrically connected to a bias voltage source. It is also the only configuration disclosed in said patent which achieves the object of the present invention. Two filaments 12 and 13 in this case are surrounded by individual mesh electrodes 31 and 32 which are floating and act in a similar manner to mesh electrode 21 in FIG. 2. Mesh electrodes 31, 32 substantially surround filaments 12, 13, except that they are open-ended. In this configuration a negligible amount of decomposed coatings from filaments 12, 13 could escape through the openings at the opposed ends of said mesh. In addition, this configuration reduces the rate of ion bombardment to each filament 12, 13 when it is acting as the cathode, thus lowering the sputtering rate. An increase in operating voltage results when this configuration is used, as described in U.S. Pat. No. 4,512,718, supra.

Figure 4:
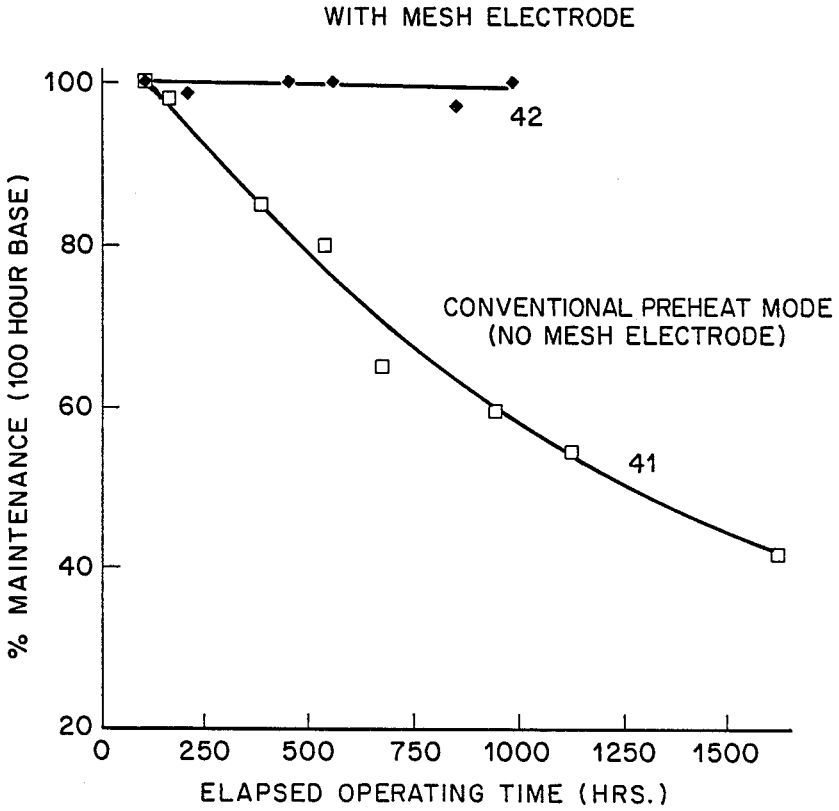
FIG. 4 is a diagram of dual cathode BMD lamp maintenance comparing the characteristic of the embodiment shown in FIG. 2 with the prior art device depicted in FIG. 1.

The magnitude of maintenance improvement through the use of the additional mesh electrode 21 can be seen in FIG. 4. Relative light output, as a function of operating time, for a conventional dual filament BMD lamp 10 operated in the preheat mode is shown in curve 41. A BMD lamp with the additional third mesh electrode 21 operating in a floating bias condition exhibited an improved maintenance characteristic as shown by curve 42 of FIG. 4.

This invention sets forth an improved BMD lamp maintenance characteristic through the use of an additional third "mesh" electrode without incurring reduced electron emissive characteristics. Two "mesh" electrode configurations are described. The configuration in FIG. 3 has the added feature of lowered sputtering rate.

Although only two different "mesh" electrode configurations are shown here, other configurations of this electrode will also accomplish the same goal. In addition, the electrode potential could be controlled through a connection to the outside instead of being allowed to float to whatever potential the discharge dictates.

Other modifications will suggest themselves without departing from the spirit and scope of this invention.

What is claimed is:

1. An improved beam mode fluorescent lamp wherein said lamp has an enclosing light transmissive lamp envelope having an interior surface; a lamp base with a socket therewithin coupled to said envelope to form a complete enclosure with said envelope; a phosphor coating deposited on said interior surfaces of said envelope for converting ultraviolet radiation to visible radiation; a fill of noble gas and mercury vapor within said enclosure; a first filament covered with an alkaline earth coating having a pair of opposed ends; a first set of filament connecting leads for coupling said ends to said socket; a second filament covered with an alkaline earth coating having a pair of opposed ends; a second set of filament connecting leads for coupling said ends of said second filament to said socket; and said alkaline earth coatings having a tendency to decompose into elemental form upon application of heat thereto; wherein the improvement comprises:

an electrically floating conductive grid means; wherein said grid means is a singular cylindrical structure which substantially surrounds both of said filaments and is closed off at one end adjacent said filaments and is closed off at an opposite end by a portion of said lamp base to provide a mesh that is interposed between said filaments and said phosphor layer such that particles of said decomposing coatings cannot diffuse unobstructed form said filaments to said phosphor layer; and such that said grid means during operation of said lamp acquires a negative potential with respect to the plasma and selectively acquires positively ionized particles from said decomposing alkaline earth coating.

* * * * *

UNITED STATES PATENT OFFICE

CERTIFICATE OF CORRECTION

Patent No. 4,866,339 Dated September 12, 1989

Inventor(s) BUDINGER, A. BOWMAN, et al

It is certified that error appears in the above-identified patent and that said Letters Patent is hereby corrected as shown below:

Cover page, item [75], after "Hills," insert -- Jakob Maya, Brookline, --

Cover page, item [73], after "Waltham," insert -- GTE Products Corporation, Danvers, both of --

Col 4, line 51, change "form" to -- from --

Signed and Sealed this

Eighteenth Day of June, 1991

*Attest:*

HARRY F. MANBECK, JR.

*Attesting Officer*

*Commissioner of Patents and Trademarks*